US010986899B2

(12) United States Patent
Lee et al.

(10) Patent No.: US 10,986,899 B2
(45) Date of Patent: Apr. 27, 2021

(54) HAND FIXATION BAND

(71) Applicant: Cheng Uei Precision Industry Co., Ltd., New Taipei (TW)

(72) Inventors: Tsung Shih Lee, New Taipei (TW); Chi Ming Tseng, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 16/583,647

(22) Filed: Sep. 26, 2019

(65) Prior Publication Data

US 2020/0367609 A1 Nov. 26, 2020

(30) Foreign Application Priority Data

May 23, 2019 (CN) ..... 201920748301.0

(51) Int. Cl.
*A44B 1/08* (2006.01)

(52) U.S. Cl.
CPC ..... *A44B 1/08* (2013.01)

(58) Field of Classification Search
CPC ..... A44B 1/08; A45C 13/26; Y10T 16/455; Y10T 16/3831
See application file for complete search history.

(56) References Cited

U.S. PATENT DOCUMENTS 2,735,700 A * 2/1956 Bowan et al. ..... F16L 19/061 277/623
3,343,634 A * 9/1967 Goldman ..... A45C 13/26 16/410
3,491,854 A * 1/1970 Baxter ..... A44B 19/24 184/109
3,571,843 A * 3/1971 Szabo ..... A45C 13/26 16/405
7,712,590 B1 * 5/2010 Lee ..... A45C 13/26 190/115
9,583,078 B1 * 2/2017 Nagahara ..... G10D 7/026
10,482,853 B1 * 11/2019 Nagahara ..... G10D 7/026
10,537,778 B2 * 1/2020 Mayer, II ..... A63B 67/14
10,563,680 B2 * 2/2020 Benthaus ..... F16B 5/0657
2005/0263364 A1 * 12/2005 Sher ..... A45C 13/26 190/115
2018/0163917 A1 * 6/2018 Govindasamy ..... F16M 11/08

* cited by examiner

*Primary Examiner* — Victor D Batson
*Assistant Examiner* — Matthew J Sullivan
(74) *Attorney, Agent, or Firm* — Lin & Associates Intellectual Property, Inc.

(57) ABSTRACT

A hand fixation band includes a fastening band, a sliding arm and a damping element. The fastening band has a main portion, and a connecting portion protruded outward from one end of the main portion. A bottom surface of the connecting portion is defined as a contact surface. The sliding arm is connected with the fastening band. One end of the sliding arm disposed under the connecting portion is recessed downward to form an accommodating groove. A top of a peripheral wall of the accommodating groove is inclined outward from bottom to top to form a first inclined surface. The damping element is disposed in the accommodating groove and contacts with the contact surface. A periphery of a bottom surface of the damping element is inclined outward from bottom to top to form a second inclined surface. The first inclined surface contacts with the second inclined surface.

15 Claims, 4 Drawing Sheets

HAND FIXATION BAND

CROSS-REFERENCE TO RELATED APPLICATION

The present application is based on, and claims priority from, China Patent Application No. 201920748301.0, filed May 23, 2019, the disclosure of which is hereby incorporated by reference herein in its entirety.

BACKGROUND OF THE INVENTION

1. Field of the Invention

The present invention generally relates to a hand fixation band, and more particularly to a hand fixation band having a stable pivot structure.

2. The Related Art

A conventional hand fixation band is assembled to a rocker. The conventional hand fixation band includes a fastening band, a damping element and a sliding arm. The damping element is assembled between the fastening band and the sliding arm to form a pivot structure which is pivotal and fixed in place.

However, after the pivot structure of the conventional hand fixation band pivots for many times, the damping element will be deformed to be exposed outside on account of an friction affection. Thus an appearance and a function of the pivot structure of the conventional hand fixation band are affected.

In view of the above-mentioned problems, an innovative hand fixation band is essential to be provided, the innovative hand fixation band has a stable pivot structure, and the hand fixation band keeps a stable function and a normal appearance under a long time use of the hand fixation band.

SUMMARY OF THE INVENTION

An object of the present invention is to provide a hand fixation band assembled to a rocker. The hand fixation band includes a fastening band, a sliding arm and a damping element. The fastening band has a main portion, and a connecting portion protruded outward from a middle of one end of the main portion. A bottom surface of the connecting portion is defined as a contact surface. The sliding arm is connected with the fastening band. A top surface of one end of the sliding arm disposed under a free end of the connecting portion is recessed downward to form an accommodating groove. A top of a peripheral wall of the accommodating groove is inclined outward from bottom to top to form a first inclined surface. The other end of the sliding arm opens at least one external fastening hole used for being connected with the rocker. The fastening band is rotatable with respect to the sliding arm. Rotation angles of the fastening band with respect to the sliding arm are any angles in an approximately horizontal direction. The damping element is disposed in the accommodating groove, and a top surface of the damping element contacts with the contact surface. A periphery of a bottom surface of the damping element is inclined outward from bottom to top to form a second inclined surface corresponding to and matched with the first inclined surface. The first inclined surface contacts with the second inclined surface. The second inclined surface abuts against the first inclined surface. A bottom wall of the accommodating groove and a bottom of the peripheral wall of the accommodating groove are located under a middle of the bottom surface of the damping element. The middle of the bottom surface of the damping element is spaced from a top surface of the bottom wall of the accommodating groove to form a buffering space between the middle of the bottom surface of the damping element and the top surface of the bottom wall of the accommodating groove. When the fastening band is rotated with respect to the sliding arm, the buffering space makes the middle of the bottom surface of the damping element be without contacting the top surface of the bottom wall of the accommodating groove to reduce a resistance force among the damping element, the sliding arm and the fastening band.

Another object of the present invention is to provide a hand fixation band. The hand fixation band includes a fastening band, a sliding arm, a damping element and a fixing assembly. The fastening band has a main portion, and a connecting portion protruded outward from one end of the main portion. A bottom surface of the connecting portion is defined as a contact surface. The sliding arm is connected with the fastening band. One end of the sliding arm is mounted under one end of the connecting portion. A top surface of the one end of the sliding arm is recessed downward to form an accommodating groove. A top of a peripheral wall of the accommodating groove is inclined outward from bottom to top to form a first inclined surface. The other end of the sliding arm opens at least one external fastening hole used for being connected with the rocker. The fastening band is rotatable with respect to the sliding arm. Rotation angles of the fastening band with respect to the sliding arm are any angles in an approximately horizontal direction. The damping element is disposed in the accommodating groove. A top surface of the damping element contacts with the contact surface. A periphery of a bottom surface of the damping element is inclined outward from bottom to top to form a second inclined surface corresponding to and matched with the first inclined surface. The first inclined surface contacts with the second inclined surface. The second inclined surface abuts against the first inclined surface. A bottom wall of the accommodating groove and a bottom of the peripheral wall of the accommodating groove are located under a middle of the bottom surface of the damping element. The middle of the bottom surface of the damping element is spaced from a top surface of the bottom wall of the accommodating groove to form a buffering space between the middle of the bottom surface of the damping element and the top surface of the bottom wall of the accommodating groove. The fixing assembly is fastened between the sliding arm and the fastening band. When the fastening band is rotated with respect to the sliding arm, the buffering space makes the middle of the bottom surface of the damping element be without contacting the top surface of the bottom wall of the accommodating groove to reduce a resistance force among the damping element, the sliding arm and the fastening band.

Another object of the present invention is to provide a hand fixation band. The hand fixation band includes a fastening band, a sliding arm, a damping element and a fixing assembly. The fastening band has a main portion, and a connecting portion protruded outward from the main portion. A bottom surface of the connecting portion is defined as a contact surface. One end of the sliding arm is mounted under one end of the connecting portion. A top surface of the one end of the sliding arm is recessed downward to form an accommodating groove. A top of a peripheral wall of the accommodating groove is inclined outward from bottom to top to form a first inclined surface.

The damping element is disposed in the accommodating groove. A top surface of the damping element contacts with the contact surface. A middle of the damping element opens a third fastening hole. A periphery of a bottom surface of the damping element is inclined outward from bottom to top to form a second inclined surface corresponding to and matched with the first inclined surface. The first inclined surface contacts with the second inclined surface. The second inclined surface abuts against the first inclined surface. A bottom wall of the accommodating groove and a bottom of the peripheral wall of the accommodating groove are located under a middle of the bottom surface of the damping element. The middle of the bottom surface of the damping element is spaced from a top surface of the bottom wall of the accommodating groove to form a buffering space between the middle of the bottom surface of the damping element and the top surface of the bottom wall of the accommodating groove. The fixing assembly is fastened between the sliding arm and the fastening band. The fixing assembly includes an upper fixing element and a lower fixing element. The upper fixing element has an upper base portion, and an upper fastening pillar protruded downward from a bottom surface of the upper base portion. The lower fixing element has a lower base portion, and a lower fastening pillar protruded upward from a top surface of the lower base portion. The lower fixing element opens a fixing groove penetrating through a top surface of the lower fastening pillar and a bottom surface of the lower base portion. The lower fastening pillar passes upward through the first fastening hole, the third fastening hole and the second fastening hole. The upper fastening pillar is assembled in the fixing groove. The upper fixing element and the lower fixing element are fixed with each other. The other end of the sliding arm opens at least one external fastening hole used for being connected with the rocker, the fastening band is rotatable with respect to the sliding arm, rotation angles of the fastening band with respect to the sliding arm are any angles in an approximately horizontal direction. When the fastening band is rotated with respect to the sliding arm, the buffering space makes the middle of the bottom surface of the damping element be without contacting the top surface of the bottom wall of the accommodating groove to reduce a resistance force among the damping element, the sliding arm and the fastening band.

As described above, the damping element of the hand fixation band is assembled in the accommodating groove to make the second inclined surface abut against and contact with the first inclined surface, the first inclined surface of the accommodating groove will generate a lateral force, so that the damping element in the accommodating groove will be without being deformed or shifted, and correspondingly the hand fixation band still keeps a stable function and a normal appearance under a long time use of the hand fixation band. Furthermore, the hand fixation band has a stable pivot structure.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
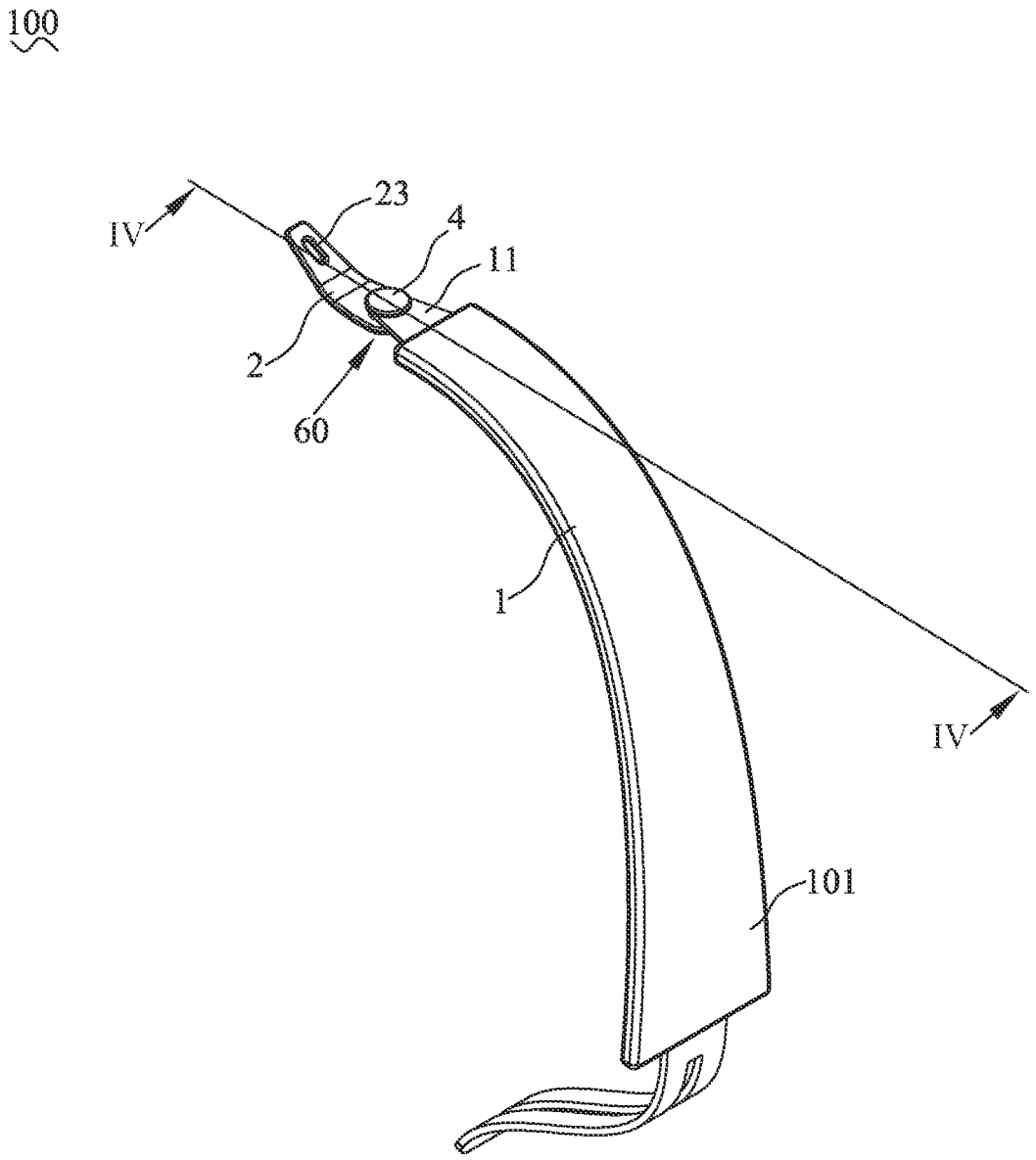
FIG. 1 is a perspective view of a hand fixation band in accordance with a preferred embodiment of the present invention.
Figure 2:
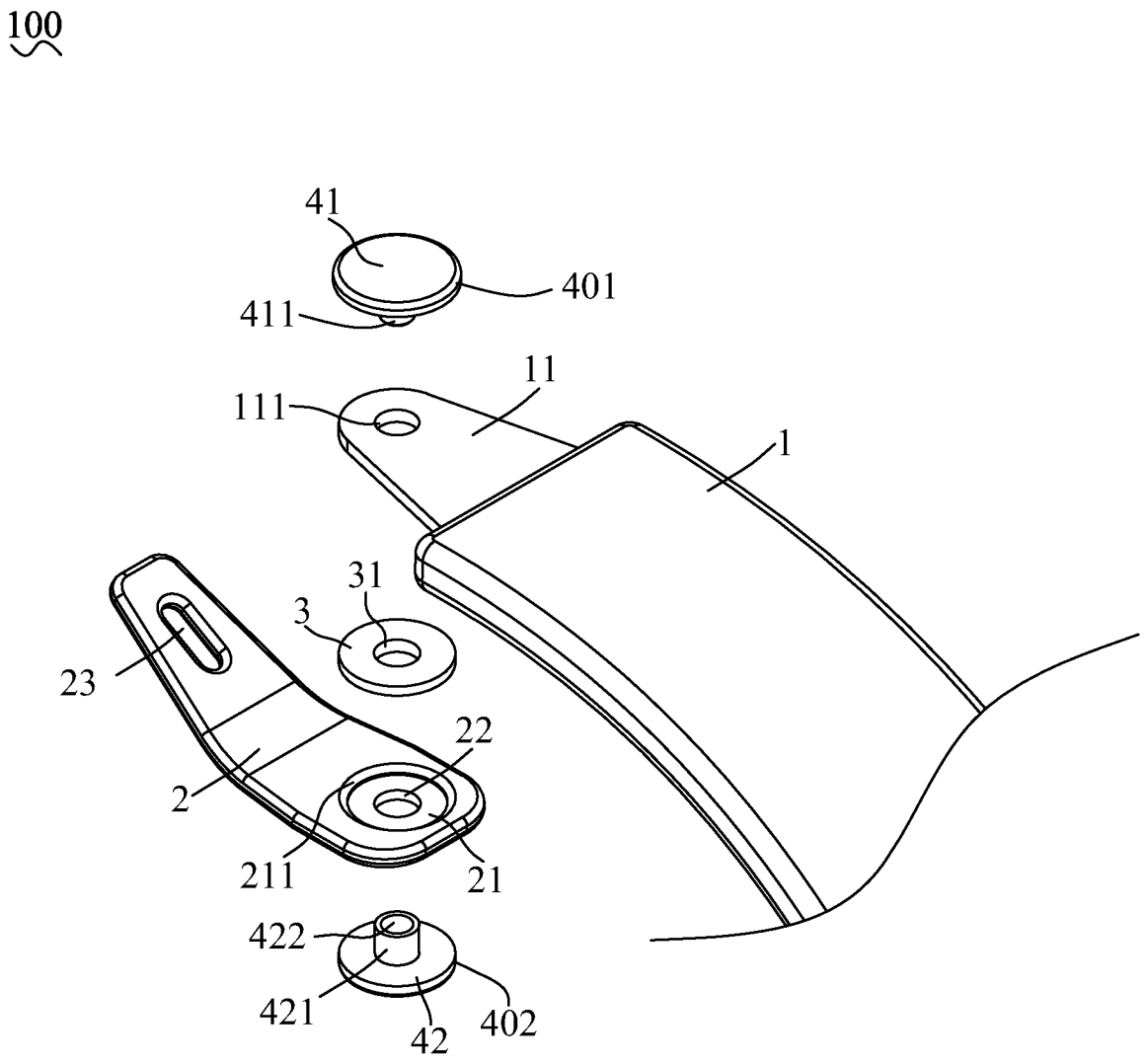
FIG. 2 is an exploded perspective view of the hand fixation band of FIG. 1.
Figure 3:
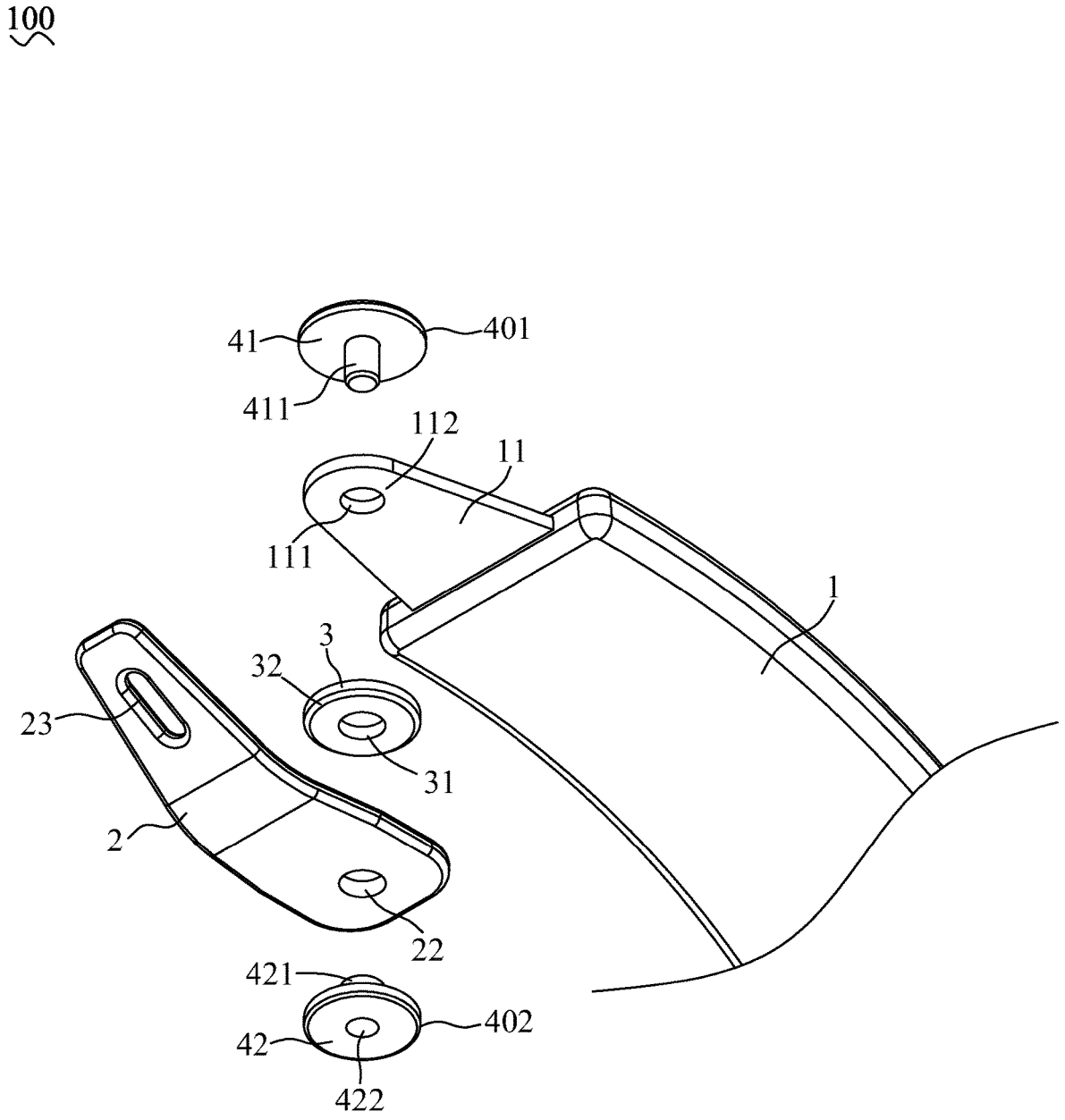
FIG. 3 is another exploded perspective view of the hand fixation band of FIG. 2.
Figure 4:
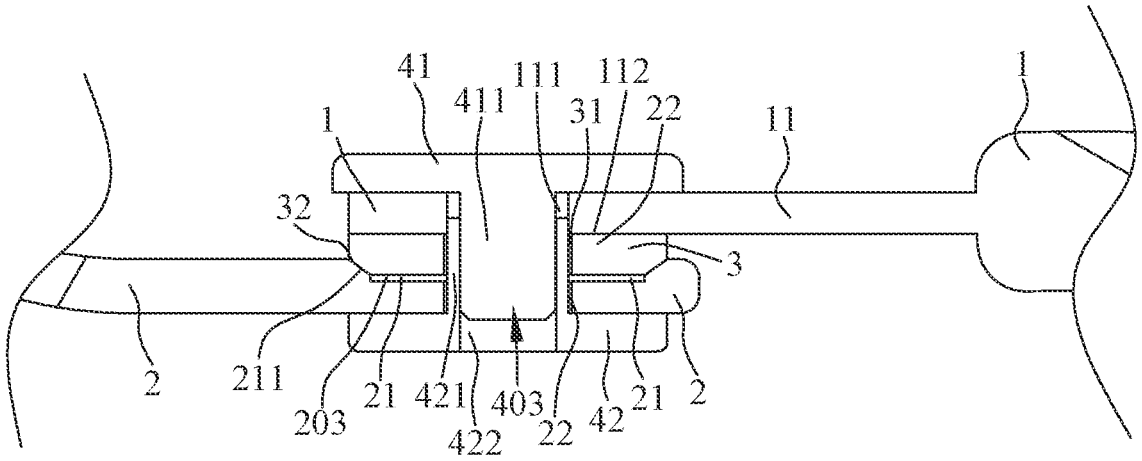
FIG. 4 is a sectional view of the hand fixation band along a line IV-IV of FIG. 1.

With reference to FIG. 1 to FIG. 4, a hand fixation band 100 in accordance with a preferred embodiment of the present invention is shown. The hand fixation band 100 is assembled to a rocker (not shown). The hand fixation band 100 includes a fastening band 1, a sliding arm 2, a damping element 3 and a fixing assembly 4. The hand fixation band 100 is flexible. The sliding arm 2, the damping element 3 together with the fixing assembly 4, and the fastening band 1 are sequentially arranged along an up-down direction.

The fastening band 1 has a main portion 101, and a connecting portion 11 protruded outward from a middle of one end of the main portion 101. The main portion 101 is shown as an arc shape. A bottom surface of the main portion 101 is arched upward and frontward. A middle of a free end of the connecting portion 11 opens a first fastening hole 111. A bottom surface of the connecting portion 11 of the fastening band 1 is defined as a contact surface 112. The sliding arm 2 is connected with the fastening band 1. One end of the sliding arm 2 is mounted under one end of the connecting portion 11. A top surface of the one end of the sliding arm 2 disposed under a free end of the connecting portion 11 of the fastening band 1 is recessed downward to form an accommodating groove 21. Specifically, the accommodating groove 21 is shown as a circular ring shape. A top of a peripheral wall of the accommodating groove 21 is inclined outward from bottom to top to form a first inclined surface 211. A middle of a bottom wall of the accommodating groove 21 has a second fastening hole 22 penetrating through a middle of the sliding arm 2. The second fastening hole 22 penetrates through the middle of the bottom wall of the accommodating groove 21. The second fastening hole 22 is communicated with the accommodating groove 21. The second fastening hole 22 is disposed corresponding to the first fastening hole 111. The other end of the sliding arm 2 opens at least one external fastening hole 23. The at least one external fastening hole 23 is used for being connected with the rocker.

The damping element 3 is shown as the circular ring shape and is matched with the accommodating groove 21. The damping element 3 is disposed in the accommodating groove 21 and a top surface of the damping element 3 contacts with the contact surface 112. Specifically, a material of the damping element 3 is rubber. A middle of the damping element 3 opens a third fastening hole 31. The third fastening hole 31 is disposed corresponding to the first fastening hole 111. A periphery of a bottom surface of the damping element 3 is inclined outward from bottom to top to form a second inclined surface 32 corresponding to and matched with the first inclined surface 211. The first inclined surface 211 contacts with the second inclined surface 32. The third fastening hole 31 penetrates through middles of the top surface and the bottom surface of the damping element 3. The second inclined surface 32 abuts against the first inclined surface 211. The bottom wall of the accommodating groove 21 and a bottom of the peripheral wall of the accommodating groove 21 are located under a middle of the bottom surface of the damping element 3. The middle of the bottom surface of the damping element 3 is spaced from a top surface of the bottom wall of the accommodating groove 21 to form a buffering space 203 between the middle of the bottom surface of the damping element 3 and the top surface of the bottom wall of the accommodating groove 21. The buffering space 203 is shown as the circular ring shape which is the same as shapes of the accommodating groove 21 and the damping element 3. When the fastening band 1 is rotated with respect to the sliding arm 2, the buffering space 203 makes the middle of the bottom surface of the damping element 3 be without contacting the top surface of the bottom wall of the accommodating groove 21 to reduce a resistance force among the damping element 3, the sliding arm 2 and the fastening band 1. The buffering space 203 makes a rotation of the fastening band 1 with respect to the sliding arm 2 more conveniently and flexibly.

Referring to FIG. 1 to FIG. 4, the fixing assembly 4 fastened between the sliding arm 2 and the fastening band 1, includes an upper fixing element 41, and a lower fixing element 42 fixed with and matched with the upper fixing element 41. The upper fixing element 41 has a circular upper base portion 401, and an upper fastening pillar 411 protruded downward from a middle of a bottom surface of the upper base portion 401. The lower fixing element 42 has a circular lower base portion 402, and a lower fastening pillar 421 protruded upward from a middle of a top surface of the lower base portion 402. A middle of the lower fixing element 42 opens a fixing groove 422 extending vertically, and penetrating through a top surface of the lower fastening pillar 421 and a bottom surface of the lower base portion 402. The fixing groove 422 is disposed corresponding to the upper fastening pillar 411.

Specifically, the fixing assembly 4 is a rivet assembly. When the hand fixation band 100 is assembled, the damping element 3 is accommodated in the accommodating groove 21 of the sliding arm 2. At the moment, the first inclined surface 211 contacts with the second inclined surface 32. The connecting portion 11 of the fastening band 1 is positioned on the damping element 3. The contact surface 112 of the fastening band 1 contacts with a top surface of the damping element 3. At the moment, The first fastening hole 111, the third fastening hole 31 and the second fastening hole 22 are communicated with one another. The lower fastening pillar 421 of the lower fixing element 42 passes upward through the first fastening hole 111, the third fastening hole 31 and the second fastening hole 22. The upper fastening pillar 411 of the fixing assembly 4 is assembled in the fixing groove 422, so that the upper fixing element 41 and the lower fixing element 42 are fixed with each other, and correspondingly the fastening band 1, the damping element 3 and the sliding arm 2 are combined by the fixing assembly 4.

When the hand fixation band 100 of the rocker is held by a user, the fastening band 1 surrounds a hand of the user to make the hand of the user hold the rocker stably. The sliding arm 2 is connected with the fastening band 1 and the rocker. The sliding arm 2 is connected with the fastening band 1 by the fixing assembly 4 to form a stable pivot structure 60 so as to make the fastening band 1 movable with respect to the sliding arm 2, and to make the fastening band 1 rotatable around pivoting the lower fastening pillar 421 and the upper fastening pillar 411. The fastening band 1 is rotatable with respect to the sliding arm 2, rotation angles of the fastening band 1 with respect to the sliding arm 2 are any angles in an approximately horizontal direction. One of the rotation angles of the fastening band 1 with respect to the sliding arm 2 is 360 degrees in the approximately horizontal direction. So the hand fixation band 100 is used flexibly and has enough rotation angles. The damping element 3 is blocked by a periphery of the one end of the sliding arm 2, when the connecting portion 11 of the fastening band 1 is rotated with respect to the sliding arm 2, the damping element 3 is without being deformed and exposed beyond outer surfaces of the connecting portion 11 of the fastening band 1, the sliding arm 2, and the upper fixing element 41 and the lower fixing element 42 of the fixing assembly 4 on account of a friction force pressing and pushing the damping element 3. The fixing assembly 4 is fastened between the sliding arm 2 and the fastening band 1. The hand fixation band 100 is appropriate for each of hand shapes of different users by virtue of adjusting a position of the fastening band 1 of the hand fixation band 100. So when the user adjusts the position of the fastening band 1 of the hand fixation band 100, the fastening band 1 and the sliding arm 2 will generate a pivot rotation by means of a pivoting portion 403 of the fixing assembly 4 pivotally connected between the fastening band 1 and the sliding arm 2. The pivoting portion 403 of the fixing assembly 4 includes the lower fastening pillar 421 and the upper fastening pillar 411. In the preferred embodiment, the fastening band 1 and the sliding arm 2 will generate the pivot rotation by means of the upper fastening pillar 411 and the lower fastening pillar 421 of the fixing assembly 4. At the moment, the damping element 3 disposed between the connecting portion 11 of the fastening band 1 and the sliding arm 2 is capable of providing a static friction force and a kinetic friction force.

The static friction force is capable of making the fastening band 1 and the sliding arm 2 complete a location after generating the pivot rotation between the fastening band 1 and the sliding arm 2. When the user adjusts the position of the fastening band 1, the kinetic friction force will be without affecting the pivot rotation between the fastening band 1 and the sliding arm 2. The damping element 3 is accommodated in the accommodating groove 21 to make the second inclined surface 32 abut against and contact with the first inclined surface 211. After multiple pivot rotations are generated between the fastening band 1 and the sliding arm 2, the first inclined surface 211 of the accommodating groove 21 will generate a lateral force, so that the damping element 3 in the accommodating groove 21 will be without being deformed or shifted, and correspondingly the hand fixation band 100 still keeps a stable function and a normal appearance under a long time use of the hand fixation band 100.

As described above, the damping element 3 of the hand fixation band 100 is assembled in the accommodating groove 21 to make the second inclined surface 32 abut against and contact with the first inclined surface 211, the first inclined surface 211 of the accommodating groove 21 will generate the lateral force, so that the damping element 3 in the accommodating groove 21 will be without being deformed or shifted, and correspondingly the hand fixation band 100 still keeps the stable function and the normal appearance under the long time use of the hand fixation band 100. Furthermore, the hand fixation band 100 has the stable pivot structure 60.

What is claimed is:

1. A hand fixation band assembled to a rocker, comprising:

a fastening band having a main portion, and a connecting portion protruded outward from a middle of one end of the main portion, a bottom surface of the connecting portion being defined as a contact surface;

a sliding arm connected with the fastening band, a top surface of one end of the sliding arm disposed under a free end of the connecting portion being recessed downward to form an accommodating groove, a top of a peripheral wall of the accommodating groove being inclined outward from bottom to top to form a first inclined surface, the other end of the sliding arm opening at least one external fastening hole used for being connected with the rocker, the fastening band being rotatable with respect to the sliding arm, rotation angles of the fastening band with respect to the sliding arm being any angles in an approximately horizontal direction; and a damping element disposed in the accommodating groove, and a top surface of the damping element contacting with the contact surface, a periphery of a bottom surface of the damping element being inclined outward from bottom to top to form a second inclined surface corresponding to and matched with the first inclined surface, the first inclined surface contacting with the second inclined surface, the second inclined surface abutting against the first inclined surface, a bottom wall of the accommodating groove and a bottom of the peripheral wall of the accommodating groove being located under a middle of the bottom surface of the damping element, the middle of the bottom surface of the damping element being spaced from a top surface of the bottom wall of the accommodating groove to form a buffering space between the middle of the bottom surface of the damping element and the top surface of the bottom wall of the accommodating groove, wherein when the fastening band is rotated with respect to the sliding arm, the buffering space makes the middle of the bottom surface of the damping element be without contacting the top surface of the bottom wall of the accommodating groove to reduce a resistance force among the damping element, the sliding arm and the fastening band.

2. The hand fixation band as claimed in claim 1, wherein the accommodating groove is shown as a circular ring shape.

3. The hand fixation band as claimed in claim 1, wherein a middle of the free end of the connecting portion opens a first fastening hole, a middle of the bottom wall of the accommodating groove has a second fastening hole penetrating through a middle of the sliding arm, a middle of the damping element opens a third fastening hole, the first fastening hole, the third fastening hole and the second fastening hole are communicated with one another.

4. The hand fixation band as claimed in claim 3, wherein the second fastening hole is communicated with the accommodating groove.

5. The hand fixation band as claimed in claim 3, further comprising a fixing assembly fastened between the sliding arm and the fastening band, the fixing assembly including an upper fixing element and a lower fixing element, the upper fixing element having an upper base portion, and an upper fastening pillar protruded downward from a bottom surface of the upper base portion, the lower fixing element having a lower base portion, and a lower fastening pillar protruded upward from a top surface of the lower base portion, the lower fixing element opening a fixing groove extending vertically, and penetrating through a top surface of the lower fastening pillar and a bottom surface of the lower base portion, the fixing groove being disposed corresponding to the upper fastening pillar, the lower fastening pillar of the lower fixing element passing upward through the first fastening hole, the third fastening hole and the second fastening hole, the upper fastening pillar being assembled in the fixing groove, the upper fixing element and the lower fixing element being fixed with each other, and correspondingly the fastening band, the damping element and the sliding arm being combined by the fixing assembly.

6. A hand fixation band assembled to a rocker, comprising:

a fastening band having a main portion, and a connecting portion protruded outward from one end of the main portion, a bottom surface of the connecting portion being defined as a contact surface;

a sliding arm connected with the fastening band, one end of the sliding arm being mounted under one end of the connecting portion, a top surface of the one end of the sliding arm being recessed downward to form an accommodating groove, a top of a peripheral wall of the accommodating groove being inclined outward from bottom to top to form a first inclined surface, the other end of the sliding arm opening at least one external fastening hole used for being connected with the rocker, the fastening band being rotatable with respect to the sliding arm, rotation angles of the fastening band with respect to the sliding arm being any angles in an approximately horizontal direction;

a damping element disposed in the accommodating groove, a top surface of the damping element contacting with the contact surface, a periphery of a bottom surface of the damping element being inclined outward from bottom to top to form a second inclined surface corresponding to and matched with the first inclined surface, the first inclined surface contacting with the second inclined surface, the second inclined surface abutting against the first inclined surface, a bottom wall of the accommodating groove and a bottom of the peripheral wall of the accommodating groove being located under a middle of the bottom surface of the damping element, the middle of the bottom surface of the damping element being spaced from a top surface of the bottom wall of the accommodating groove to form a buffering space between the middle of the bottom surface of the damping element and the top surface of the bottom wall of the accommodating groove; and a fixing assembly fastened between the sliding arm and the fastening band, wherein when the fastening band is rotated with respect to the sliding arm, the buffering space makes the middle of the bottom surface of the damping element be without contacting the top surface of the bottom wall of the accommodating groove to reduce a resistance force among the damping element, the sliding arm and the fastening band.

7. The hand fixation band as claimed in claim 6, wherein the accommodating groove is shown as a circular ring shape.

8. The hand fixation band as claimed in claim 6, wherein a middle of a free end of the connecting portion opens a first fastening hole, a middle of the bottom wall of the accommodating groove has a second fastening hole penetrating through a middle of the sliding arm, a middle of the damping element opens a third fastening hole, the first fastening hole, the third fastening hole and the second fastening hole are communicated with one another.

9. The hand fixation band as claimed in claim 8, wherein the second fastening hole is communicated with the accommodating groove.

10. The hand fixation band as claimed in claim 8, wherein the fixing assembly includes an upper fixing element and a lower fixing element, the upper fixing element has an upper base portion, and an upper fastening pillar protruded downward from a bottom surface of the upper base portion, the lower fixing element has a lower base portion, and a lower fastening pillar protruded upward from a top surface of the lower base portion, the lower fixing element opens a fixing groove extending vertically, and penetrating through a top surface of the lower fastening pillar and a bottom surface of the lower base portion, the fixing groove is disposed corresponding to the upper fastening pillar, the lower fastening pillar of the lower fixing element passes upward through the first fastening hole, the third fastening hole and the second fastening hole, the upper fastening pillar is assembled in the fixing groove, the upper fixing element and the lower fixing element are fixed with each other, and correspondingly the fastening band, the damping element and the sliding arm are combined by the fixing assembly.

11. A hand fixation band assembled to a rocker, comprising:

a fastening band having a main portion, and a connecting portion protruded outward from the main portion, a bottom surface of the connecting portion being defined as a contact surface;

a sliding arm, one end of the sliding arm being mounted under one end of the connecting portion, a top surface of the one end of the sliding arm being recessed downward to form an accommodating groove, a top of a peripheral wall of the accommodating groove being inclined outward from bottom to top to form a first inclined surface;

a damping element disposed in the accommodating groove, a top surface of the damping element contacting with the contact surface, a middle of the damping element opening a third fastening hole, a periphery of a bottom surface of the damping element being inclined outward from bottom to top to form a second inclined surface corresponding to and matched with the first inclined surface, the first inclined surface contacting with the second inclined surface, the second inclined surface abutting against the first inclined surface, a bottom wall of the accommodating groove and a bottom of the peripheral wall of the accommodating groove being located under a middle of the bottom surface of the damping element, the middle of the bottom surface of the damping element being spaced from a top surface of the bottom wall of the accommodating groove to form a buffering space between the middle of the bottom surface of the damping element and the top surface of the bottom wall of the accommodating groove; and a fixing assembly fastened between the sliding arm and the fastening band, the fixing assembly including an upper fixing element and a lower fixing element, the upper fixing element having an upper base portion, and an upper fastening pillar protruded downward from a bottom surface of the upper base portion, the lower fixing element having a lower base portion, and a lower fastening pillar protruded upward from a top surface of the lower base portion, the lower fixing element opening a fixing groove penetrating through a top surface of the lower fastening pillar and a bottom surface of the lower base portion, the lower fastening pillar passing upward through the first fastening hole, the third fastening hole and the second fastening hole, the upper fastening pillar being assembled in the fixing groove, the upper fixing element and the lower fixing element being fixed with each other, wherein the sliding arm is connected with the fastening band by the fixing assembly to form a stable pivot structure so as to make the fastening band movable with respect to the sliding arm, and to make the fastening band rotatable around the lower fastening pillar and the upper fastening pillar, the other end of the sliding arm opens at least one external fastening hole used for being connected with the rocker, the fastening band is rotatable with respect to the sliding arm, rotation angles of the fastening band with respect to the sliding arm are any angles in an approximately horizontal direction, when the fastening band is rotated with respect to the sliding arm, the buffering space makes the middle of the bottom surface of the damping element be without contacting the top surface of the bottom wall of the accommodating groove to reduce a resistance force among the damping element, the sliding arm and the fastening band.

12. The hand fixation band as claimed in claim 11, wherein the second fastening hole penetrates through a middle of the bottom wall of the accommodating groove, and the third fastening hole penetrates through middles of the top surface and the bottom surface of the damping element.

13. The hand fixation band as claimed in claim 11, wherein the damping element is shown as a circular ring shape and is matched with the accommodating groove, the buffering space is shown as the circular ring shape which is the same as shapes of the accommodating groove and the damping element.

14. The hand fixation band as claimed in claim 11, wherein one of the rotation angles of the fastening band with respect to the sliding arm is 360 degrees in the approximately horizontal direction.

15. The hand fixation band as claimed in claim 11, wherein the damping element is blocked by a periphery of the one end of the sliding arm, when the connecting portion of the fastening band is rotated with respect to the sliding arm, the damping element is without being deformed and exposed beyond outer surfaces of the connecting portion of the fastening band, the sliding arm, and the upper fixing element and the lower fixing element of the fixing assembly on account of a friction force pressing and pushing the damping element.

* * * * *